US006360927B1

(12) United States Patent
Barker

(10) Patent No.: US 6,360,927 B1
(45) Date of Patent: Mar. 26, 2002

(54) GARMENT FOLDING APPARATUS

(76) Inventor: Deborah Barker, 6550 N. Federal Hwy., Suite 240, Ft. Lauderdale, FL (US) 33308

( * ) Notice: Subject to any disclaimer, the term of this patent is extended or adjusted under 35 U.S.C. 154(b) by 0 days.

(21) Appl. No.: 09/680,020

(22) Filed: Oct. 5, 2000

Related U.S. Application Data

(60) Provisional application No. 60/157,930, filed on Oct. 6, 1999.

(51) Int. Cl.[7] ..... A41M 33/00
(52) U.S. Cl. ..... 223/37; 223/38
(58) Field of Search ..... 223/37, 38, 1; 493/405, 418, 451

(56) References Cited

U.S. PATENT DOCUMENTS

| | | | | |
|---|---|---|---|---|
| 1,657,551 A | * | 1/1928 | Schremp | 223/37 |
| 3,689,059 A | | 9/1972 | Gross | |
| 3,989,172 A | | 11/1976 | Wiedermann et al. | |
| 4,648,861 A | | 3/1987 | Pierce | |
| 5,011,052 A | | 4/1991 | Craig | |
| 5,131,574 A | | 7/1992 | Usco et al. | |
| 5,154,329 A | | 10/1992 | Dorfmueller | |
| 5,417,351 A | | 5/1995 | Grosz | |
| 5,417,641 A | | 5/1995 | Warren | |
| 5,947,349 A | | 9/1999 | Shaalan | |

OTHER PUBLICATIONS http://www.fastfold.com/instruction.html (copy attached hereto).

* cited by examiner

*Primary Examiner*—Bibhu Mohanty
(74) *Attorney, Agent, or Firm*—Stearns, Weaver, Miller, Weissler, Alhadeff & Sitterson, P.A.

(57) ABSTRACT

A garment folding apparatus for rapidly folding clothing, such as shirts and tops. The device comprises four (4) hingedly connected panels including a main panel, opposing side panels, and a bottom panel. The opposing side panels and the bottom panel are each pivotally connected to the main panel by hinge members. The panels may include apertures and depending feet for increased folding speed. The hinge members permit the folding of the panels during use and further permit the device to be configured for compact storage.

3 Claims, 4 Drawing Sheets

GARMENT FOLDING APPARATUS

CROSS REFERENCE TO RELATED APPLICATIONS

This application claims the benefit of provisional U.S. patent application Ser. No. 60/157,930, filed Oct. 6, 1999.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights.

BACKGROUND OF THE INVENTION

1. Field of the Invention

The present invention relates generally to folding devices for clothing, and more particularly to an apparatus for folding shirts and tops in an efficient, compact and uniform manner.

2. Description of the Background Art

Clothing stores commonly display garments, such as shirts and tops, on display shelving neatly folded in a compact uniform manner. Shoppers routinely rummage through garment displays, removing, unfolding, and replacing garments while shopping. In order to maintain an orderly retail display it is important that such garments be folded in a neat, compact, and uniform manner. Accordingly, store employees spend a great deal of time re-folding and re-shelving garments. As a result, the background art reveals a number of devices designed to facilitate the folding of garments so as to minimize labor costs by assisting in the folding process.

U.S. Pat. No. 5,947,349, issued to Shaalan, discloses a garment folding apparatus having a rigid body portion which serves as a folding guide. U.S. Pat. No. 5,417,641, issued to Warren, discloses a device for folding articles, such as shirts, comprising a base, a generally flat main member, and two side panels foldably attached to the main member. U.S. Pat. No. 5,417,351, issued to Grosz, discloses a portable device to aid in the folding of shirts comprising a horizontal support structure, a vertically extending support part, and a horizontal carriage projecting forwardly from the support part in substantial horizontal spaced relationship above the support structure. U.S. Pat. No. 5,154,329, issued to Dorfmueller, discloses an apparatus used for the folding and storing of a shirt. The Dorfmueller apparatus comprises a substantially flat and generally rectangular main member with arm members extending from each upper corner area of the main member. U.S. Pat. No. 5,011,052, issued to Craig, discloses a folding device for apparel consisting of a flat member having a plurality of creases that allow the operator to manipulate a shirt in vertical and horizontal stages so as to achieve proper folding. U.S. Pat. No. 5,131,574, issued to Usco et al., discloses a folding device consisting of a pivotally connected plate and frame provided with locking pieces to assist in hand-folding of shirts. U.S. Pat. No. 3,989,172, issued to Wiedemann et al., discloses a folding device for shirts that includes a stiffening panel about which the shirt is adapted to be folded. The stiffening panel forms a slit for insertably receiving a sleeve of a shirt to eliminate the need for pins.

Finally, a folding device sold under the trademark FAST FOLD™ is shown on the Internet site www.fastfold.com. The FAST FOLD device includes four hingedly connected panels which function upon manipulation by the user to fold a garment placed thereon. There are, however, a number of disadvantages with the Fast Fold device. Specifically, the panels of the Fast Fold device lay substantially flat on an underlying supporting surface, such as a table, making it difficult for the user's fingers to grasp and flip the panels during use. In addition, it has been found that rapid folding back of the panels, primarily the side panels, creates suction that causes the garment to adhere to the panel and thereby effectively unfolding the garment. Finally, the Fast Fold device is designed for use with a folding method that requires the device to be larger, and hence more difficult to handle.

Accordingly, there exists a need for an improved garment folding device that avoids the disadvantages present in the devices of the background art.

BRIEF SUMMARY OF THE INVENTION

The present invention provides a low cost garment folding apparatus for rapidly folding clothing, such as shirts and tops. The device comprises four (4) hingedly connected panels including a main panel, opposing side panels, and a bottom panel. The opposing side panels and the bottom panel are each pivotally connected to the main panel by hinge members. The hinge members permit the folding of the panels during use and further permit the device to be configured for compact storage.

The apparatus may be constructed to any suitable size. For example, one size apparatus may be configured for adult clothing and another size apparatus may be configured for children's clothing merely by altering the dimensions of the panels.

It is an object of the present invention to provide a garment folding apparatus for use as an aid in folding clothing such as shirts and tops.

Yet another object of the present invention is to provide a garment folding apparatus that is simple to use, durable, and of low cost.

Still another object of the present invention is to provide a garment folding apparatus that increases folding efficiency by enabling a user to fold shirts and tops more rapidly than with folding devices of the background art.

A further object of the present invention is to provide a garment folding apparatus that is ergonomically designed for ease of use and manipulation.

These and other objects will become are achieved with the apparatus and folding method disclosed in detail below.

DETAILED DESCRIPTION OF THE INVENTION

Figure 1:
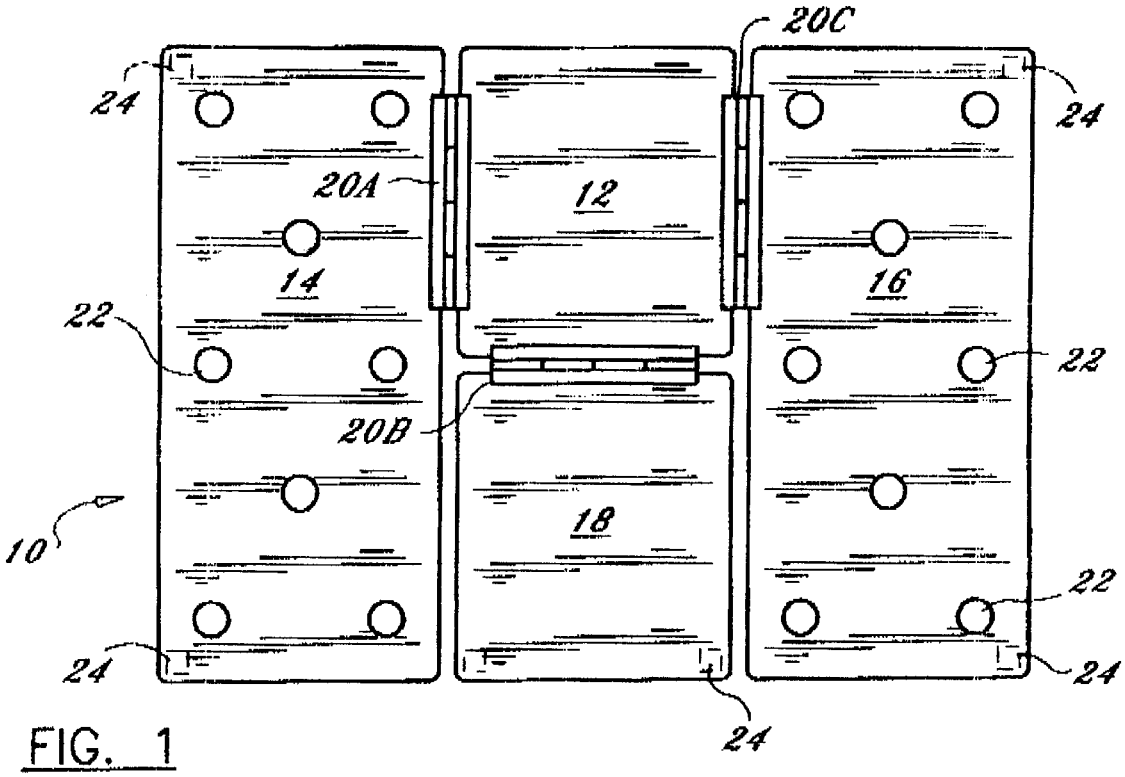
FIG. 1 is a top plan view of a garment folding apparatus according to the present invention.
Figure 2:
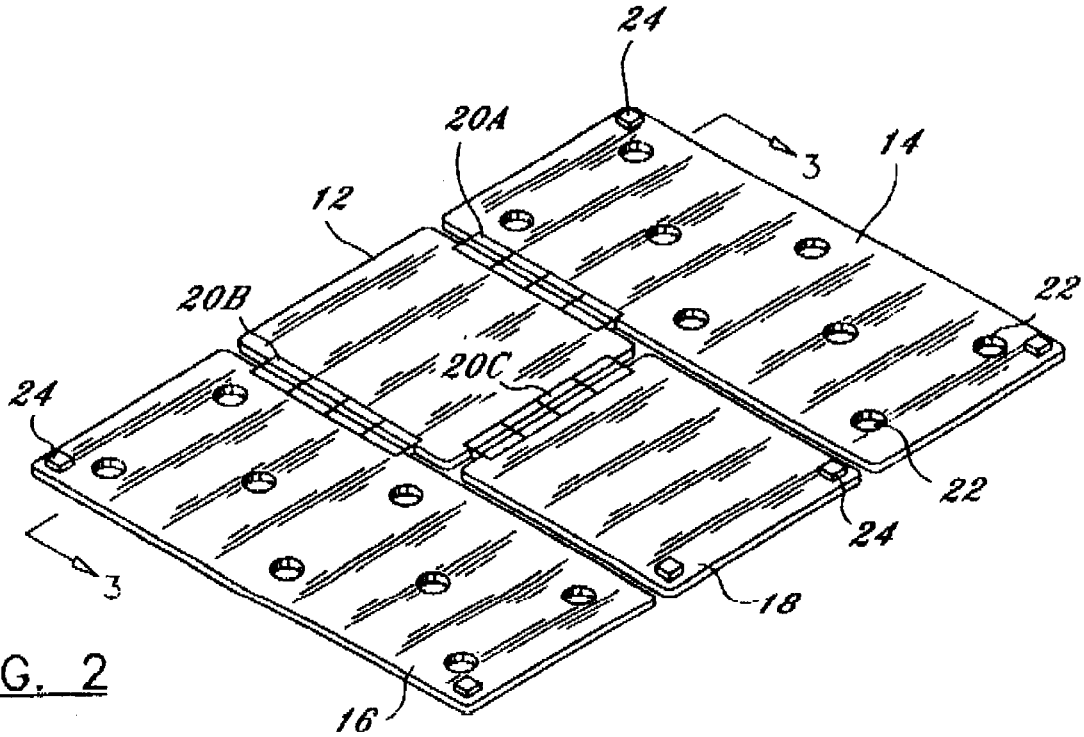
FIG. 2 is a top perspective view thereof.
Figure 3:
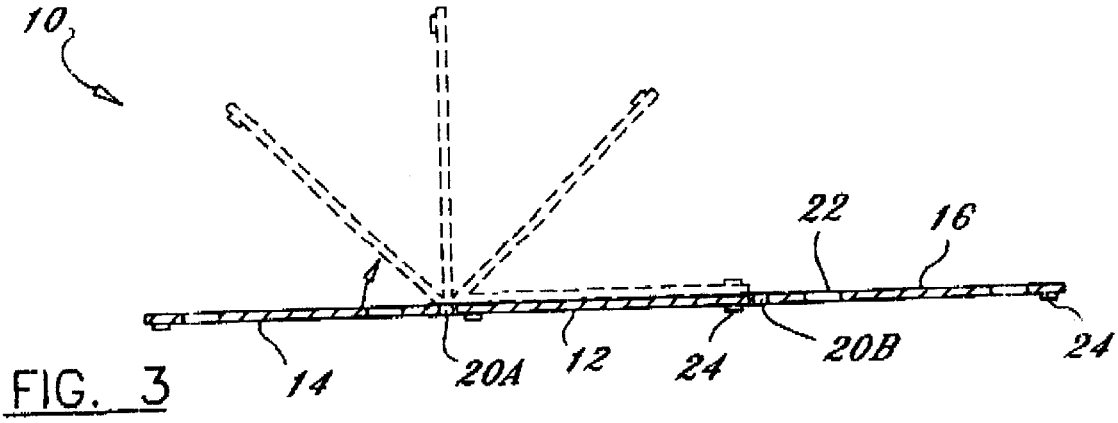
FIG. 3 is a side view thereof and illustrates the flipping of the left side panel.
Figure 4:
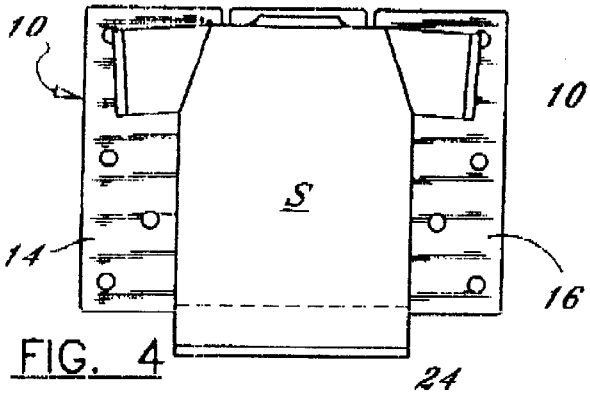
FIG. 4 is a top plan view depicting the garment folding apparatus and an unfolded shirt thereon.
Figure 9:
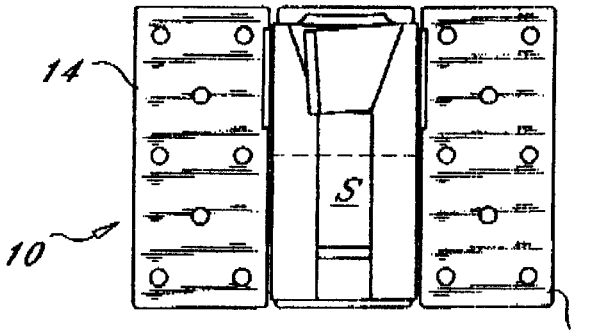
FIG. 9 is a top plan view of the of the garment folding apparatus and shirt with the right side panel folded back revealing the partially folded shirt.
Figure 10:
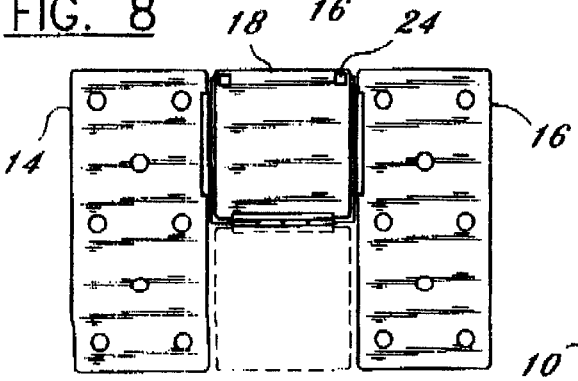
FIG. 10 is a top plan view of the garment folding apparatus and shirt with the bottom panel folded upward.
Figure 11:
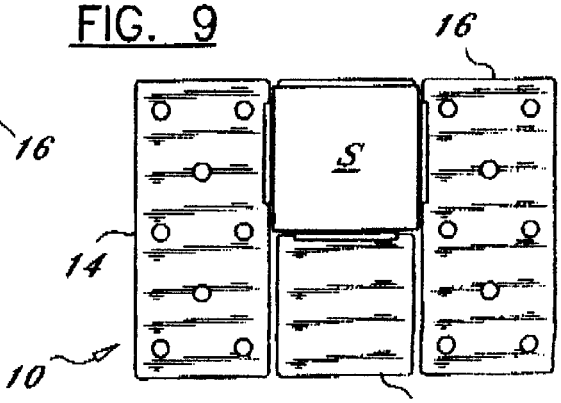
FIG. 11 is a top plan view of the garment folding apparatus and shirt with the bottom panel folded back.
Figure 12:
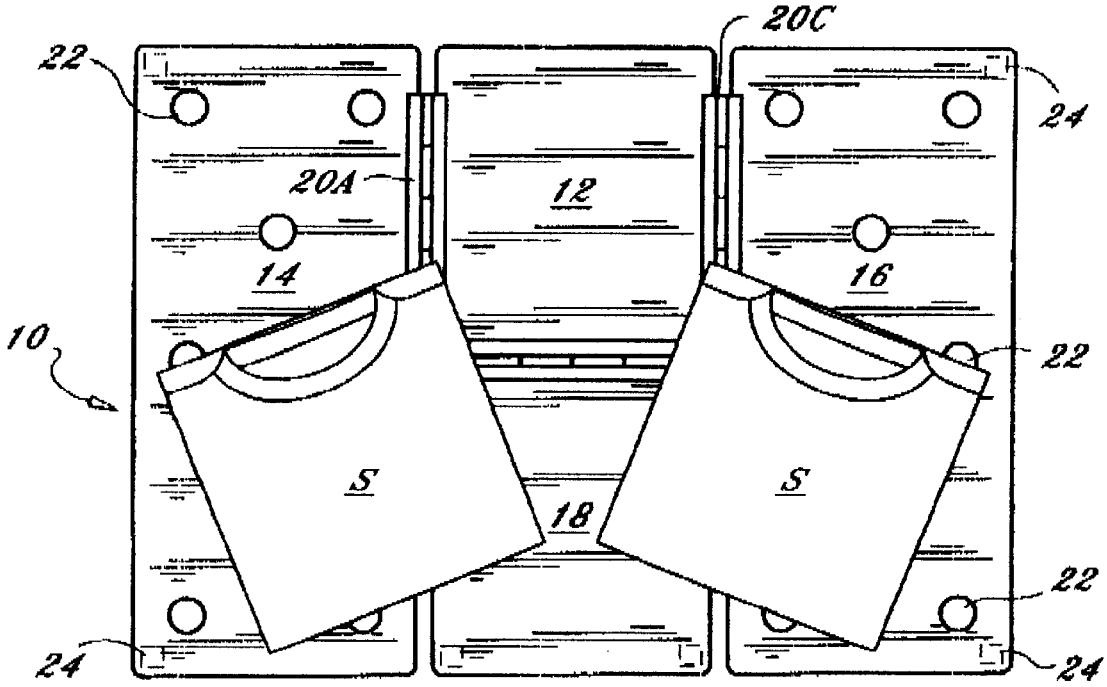
FIG. 12 is a top plan view of the garment folding apparatus and shirts folded therewith according to the method of the present invention.

With reference now to FIGS. 1 through 12 there is depicted a garment folding apparatus generally referenced as 10. The apparatus includes a plurality of substantially flat, light-weight panel members including a main panel 12, opposing left and right side panels 14 and 16, and a bottom panel 18. Panels 12, 14, 16, and 18 are preferably fabricated from a light-weight, rigid or semi-rigid material. Side panels 14 and 16 and bottom panel 18 are each connected to main panel 12 by hinge members 20 A–C. Hinge members 20 facilitate the folding of panels 14, 16, and 18 about main panel 12 as best seen in FIGS. 4 11. Side panels 14 and 16 preferably define a plurality of apertures, referenced as 22, for reasons more fully discussed below. Apertures 22 are preferably circular, however, any suitable shape (e.g. square, triangular, slotted etc.) is considered within the scope of the invention.

FIG. 3 depicts a side elevational view of the apparatus 10. As seen in FIG. 3, the bottom surfaces of panels 14 and 16 include projecting feet, referenced as 24, attached proximal the peripheral corner edges thereof. Feet 24 function to elevate the edges of the panels to facilitate grasping and manipulation thereof by the user.

Figure 5:
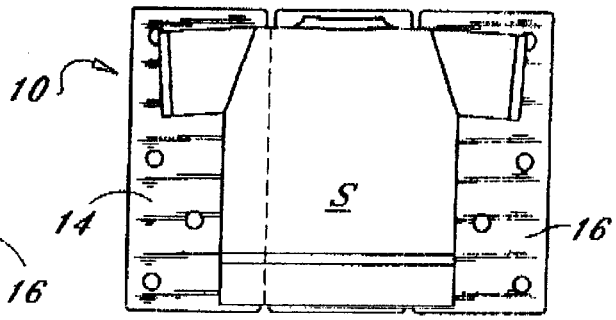
FIG. 5 is a top plan view of the garment folding apparatus and shirt depicted in FIG. 4, with the bottom portion of the shirt folded up according to the folding method disclosed herein.
Figure 6:
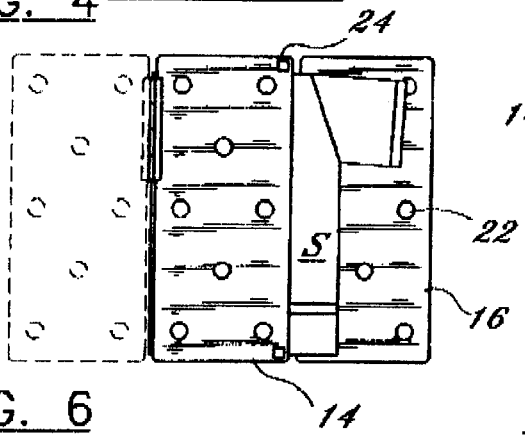
FIG. 6 is a top plan view of the garment folding apparatus and shirt with the left side panel folded over.
Figure 7:
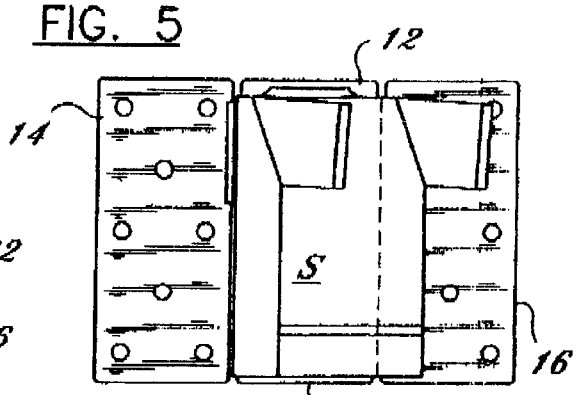
FIG. 7 is a top plan view of the garment folding apparatus and shirt with the left side panel folded back revealing the partially folded shirt.

FIG. 4 shows the garment folding apparatus 10 with a shirt, referenced as "S" placed face down in a folding position thereon. It should be noted that apparatus 10 is preferably sized such that the ends of the shirt sleeves terminate proximal the outside edges of panels 14 and 16 respectively. As best seen in FIG. 5, and according to the method of folding disclosed herein, the first step involves folding the bottom of the shirt such that the shirt fold line is approximately aligned with the lower edges of panels 14, 16 and 18. As best seen in FIG. 6, and according to the method of folding disclosed herein, the second step involves the user flipping panel 14 (or alternatively panel 16), and the shirt portion laying thereon, such that panel 14 is disposed over panels 12 and 18 with the shirt sandwiched there between thereby creating a straight and uniform fold line upon return of the panel to the position depicted in FIG. 7. Projecting feet 24 function to enable the user to easily grasp each foldable panel by causing the edge portion of each panel adapted with said feet to be slightly elevated above the underlying surface thereby enabling the user's fingers to easily slide underneath the panel while grasping.

Figure 8:
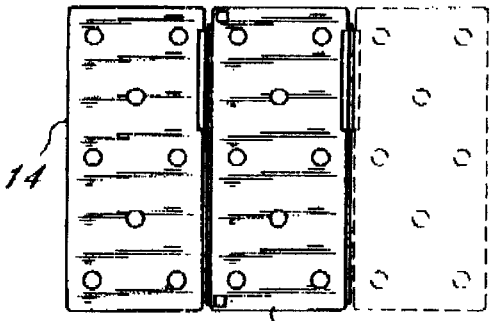
FIG. 8 is a top plan view of the garment folding apparatus and shirt with the right side panel folded over.

As best seen in FIG. 8, and according to the method disclosed herein, the third step involves the user flipping panel 16, and the shirt portion laying thereon, such that panel 16 is disposed over panels 12 and 18 with the shirt sandwiched there between. Once again, projecting feet 24 function to enable the user to easily grasp the panel. Panel 16 is then returned to its original position as depicted in FIG. 9. It should be noted that the above-referenced second and third steps, and associated returning of the panels to the original positions, are performed rapidly. Significantly, apertures 22, on each of panels 14 and 16 function, upon returning the panels to the original positions to prevent suction from unfolding the shirt as the panels are rapidly flipped back to the original positions. If the panels did not include the apertures, the rapid return of the panels would cause the shirt to adhere to the panels thereby undoing the fold and resulting in a significantly slower folding operation. Accordingly, apertures 22 provide for a more efficient folding process than is possible with folding devices known in the background art.

As best seen in FIGS. 10 and 11, and according to the fourth step of the folding method disclosed herein, panel 18, and the shirt portion thereon, is folded upward thereby completing the folding process. As should be apparent, panel 18 may also include apertures 22 and/or feet 24 to provide the advantages discussed herein above.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. An apparatus for assisting in the folding of shirts and tops, said apparatus comprising:

a plurality of hingedly connected panel members including first and second central panel members and left and right side panel members;

said second central panel member hingedly connected to a lower edge of said first central panel member;

said left and right side panel members hingedly connected to opposing side edges of said first central panel member;

said left and right side panel members each defining a plurality of apertures therein, said apertures spaced in a generally uniform manner;

said left and right side panel members each including at least one projecting foot;

whereby a shirt may be folded using said device by laying the shirt on said device such that the top of the shirt is disposed on said first central panel member and the shirt is generally centered on said device whereafter folding is accomplished by sequential flipping of said side panel members and said second central panel member.

2. An apparatus for assisting in the folding of shirts and tops, said apparatus comprising:

a plurality of hingedly connected panel members including first and second central panel members and left and right side panel members;

said second central panel member hingedly connected to a lower edge of said first central panel member;

said left and right side panel members hingedly connected to opposing side edges of said first central panel member;

said left and right side panel members each defining at plurality of apertures;

said left and right side panel members each having at least one downwardly projecting foot;

whereby a shirt may be folded using said device by laying the shirt on said device such that the top of the shirt is disposed on said first central panel member and the shirt is generally centered on said device whereafter folding is accomplished by sequential flipping of said side panel members and said second central panel member.

3. An apparatus for assisting in the folding of shirts and tops, said device comprising:

a plurality of hingedly connected panel members including first and second central panel members and left and right side panel members;

said second central panel member hingedly connected to a lower edge of said first central panel member;

said left and right side panel members hingedly connected to opposing side edges of said first central panel member;

said left and right side panel members each including at least one downwardly depending foot;

whereby a shirt may be folded using said device by laying the shirt on said device such that the top of the shirt is disposed on said first central panel member and the shirt is generally centered on said device whereafter folding is accomplished by sequential flipping of said side panel members and said second central panel member.

* * * * *